US006543876B2

(12) United States Patent
Kotaki

(10) Patent No.: US 6,543,876 B2
(45) **Date of Patent: *Apr. 8, 2003**

(54) EJECTION RECOVERY SYSTEM AND EJECTION RECOVERY METHOD

(75) Inventor: Yasuo Kotaki, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/365,901

(22) Filed: Aug. 3, 1999

(65) Prior Publication Data

US 2003/0007029 A1 Jan. 9, 2003

(30) Foreign Application Priority Data

Aug. 3, 1998 (JP) ..... 10-219449

(51) Int. Cl.[7] ..... B41J 2/165
(52) U.S. Cl. ..... 347/30; 347/29
(58) Field of Search ..... 347/30, 23, 29, 347/27, 51, 91, 32, 42, 44

(56) References Cited

U.S. PATENT DOCUMENTS

| | | | | | |
|---|---|---|---|---|---|
| 4,313,124 | A | | 1/1982 | Hara | 347/57 |
| 4,345,262 | A | | 8/1982 | Shirato et al. | 347/10 |
| 4,459,600 | A | | 7/1984 | Sato et al. | 347/47 |
| 4,463,359 | A | | 7/1984 | Ayata et al. | 347/56 |
| 4,558,333 | A | | 12/1985 | Sugitano et al. | 347/65 |
| 4,600,928 | A | * | 7/1986 | Braun et al. | 347/27 |
| 4,609,925 | A | | 9/1986 | Nozu et al. | 347/27 |
| 4,668,965 | A | | 5/1987 | Tanaka et al. | 347/26 |
| 4,723,129 | A | | 2/1988 | Endo et al. | 347/56 |
| 4,740,796 | A | | 4/1988 | Endo et al. | 347/56 |
| 4,947,191 | A | * | 8/1990 | Nozawa et al. | 347/30 |
| 5,493,319 | A | * | 2/1996 | Hirabayashi et al. | 347/29 |
| 5,539,435 | A | * | 7/1996 | Uchida et al. | 347/33 |
| 5,574,485 | A | | 11/1996 | Anderson et al. | 347/27 |
| 5,742,304 | A | * | 4/1998 | Richtsmeier et al. | 347/40 |
| 5,793,390 | A | * | 8/1998 | Claflin et al. | 347/33 |
| 6,068,363 | A | * | 5/2000 | Saito | 347/17 |
| 6,095,633 | A | * | 8/2000 | Harshbarger et al. | 347/30 |

FOREIGN PATENT DOCUMENTS

| | | |
|---|---|---|
| EP | 0 318 329 | 5/1989 |
| EP | 0 540 344 | 5/1993 |
| EP | 0 610 959 | 8/1994 |
| EP | 0 613 779 | 9/1994 |
| JP | 54-56847 | 5/1979 |
| JP | 55-17571 | 2/1980 |
| JP | 56-42661 | 4/1981 |
| JP | 59-123670 | 7/1984 |
| JP | 59-138461 | 8/1984 |
| JP | 60-71260 | 4/1985 |
| JP | 62-113555 | 5/1987 |
| JP | 5-201028 | 8/1993 |
| JP | 0 661 162 | 7/1995 |
| JP | 8-90782 | 4/1996 |

* cited by examiner

*Primary Examiner*—Shih-Wen Hsieh
(74) *Attorney, Agent, or Firm*—Fitzpatrick, Cella, Harper & Scinto

(57) ABSTRACT

An ink-jet cartridge constructed with an inkjet printing head and an ink tank is positioned and filed on an upper surface of a base in a condition where ink ejection opening forming surface of the head is oriented upwardly. The ink ejection opening forming surface is contacted with a lower end portion of an elastic member which is movable in a direction of arrow a or arrow b. By sucking through suction hole or the like of the elastic member, vacuum pressure is introduced into a space between the elastic member and the ink ejection opening forming surface to discharge bubbles residing in liquid passages or floating up to the ink ejection openings.

36 Claims, 18 Drawing Sheets

EJECTION RECOVERY SYSTEM AND EJECTION RECOVERY METHOD

This application is based on Patent Application No. 10-219449 (1998) filed Aug. 3, 1998 in Japan, the content of which is incorporated hereinto by reference.

BACKGROUND OF THE INVENTION

1. Field of the Invention

The present invention relates to an ejection recovery system and an ejection recovery method for a liquid ejection head, such as an ink-jet printing head or the like, to be mounted on an ink-jet printer, a plotter and so on, for performing printing by ejecting liquid, such as ink or the like, on a printing medium.

2. Description of the Related Art

Conventionally, as a printing system performing printing on a printing medium, such as paper, cloth, a plastic sheet, an OHP sheet or the like (hereinafter simply referred to as printing paper), there have been know various printing systems, such as a wire-dot system, a thermal printing system, a heat transfer system, an ink-jet system and so on. Among these systems, a printing apparatus employing the ink-jet system (hereinafter referred to an ink-jet printing apparatus) has been used and commercialized as output means of an information processing system, such as a printer as a copy terminal, or a handy type printer or a portable printer which can be connected to a personal computer, a host computer, a disk drive device, a video device or the like.

In the printing head to be employed in the above-mentioned ink-jet printing apparatus, energy generation elements for generating energy for ejecting ink from ejection openings are provided. As the energy generation element, there are one using an electromechanical transducer, such as a piezoelectric element, one generating heat by irradiating an electromagnetic wave, such as a laser for ejecting an ink droplet by action of the generated heat, one heating liquid by an electrothermal transducer having a heating resistor for ejecting the ink droplet, or so on.

On the other hand, for an ink-jet printing apparatus, outputting of a color image has been required for advancement of softwares and a computer in the recent year. Adapting to such situation, the ink-jet printing head is also adapted for color printing. Currently, a multi-color head has been typically realized by combining a plurality of single color heads. Also, through certain head manufacturing process, a multiple color head is present.

In addition to colorizing, higher printing density in outputting of an image has been demanded. By densification of printing density in the ink-jet system or using different ink densities, formation of higher density and higher quality of image is attempted to realize.

Then, in order to form a high density and high quality image, it has been attempted for further densification of arrangement pitch of ink ejection openings and for down-sizing of ink droplets to be ejected from the ink ejection openings by making an opening area of each ink ejection opening much smaller.

On the other hand, in the case where the multi-color head is formed by combining single color heads set out as one means for adaptation for colorizing, down-sizing of the single color head is inherent. As a result, an ink chamber formed within the head is inherently down-sized.

In the background set forth above, the entire head including the ink ejection openings and the ink chamber is inclined to be down-sized. A pre-shipment step after production of the head, an ink filling-up operation or recovery operation to the ink chamber and ink passages of the head to be mounted on an ink-jet printer or an ink-jet plotter has been performed by covering overall an ink ejection opening forming surface, with a cap formed of flexible material, and introducing vacuum within the cap for sucking the ink.

Here, a recovery cap and a recovery operation to be employed for the conventional ink-jet printing head will be explained.

FIGS. 9A and 9B show recovery cap C to be used for recovery operation of the conventional ink-jet printing head, wherein FIG. 9A is a plan view of the recovery cap C and FIG. 9B is a section taken along line IXB—IXB of FIG. 9A. The recovery cap C is generally constructed with an substantially plate-like cap guide 30, rubber caps 31*a* and 31*b* respectively fitted in two recessed portions 30*a* and 30*b* of the cap guide 30. The rubber caps 31*a* and 31*b* are respectively formed with suction holes 32*a* and 32*b* at substantially central portions. The suction holes 32*a* and 32*b* are generally formed with hole portions 30*c* and 30*d* respectively formed in the recessed portion 30*a* (not shown) of the cap guide 30 and in central bottom portion of the recessed portion 30*b*, and hole portions 31*c* and 31*d* communicated with the hole portions 30*c* and 30*d* and respectively formed in the central bottom portions of the rubber caps 31*a* and 31*b*. The rubber caps 31*a* and 31*b* are formed of a rubbery elastic material, such as a silicone rubber or a butyl rubber. Respective projection contours E of the rubber caps 31*a* and 31*b* are formed projecting from plain of the cap guide 30. Therefore, as shown in FIG. 10, when the rubber caps 31*a* and 31*b* abut on the ink ejection opening forming surface, a space defined therebetween can be a sealed space by elastic deformation of the projection contours E. The sealed space is sucked by a suction pump (not shown) via a tube 40 connected to the suction holes 32*a* and 32*b*. Sucked ink is discharged to a waste ink holder (not shown).

A relationship between the conventional ink-jet printing head and the recovery cap is downwardly oriented the ink ejection opening forming surface, of the former, and upwardly oriented the recovery cap opposing to the ink ejection opening forming surface. This condition is illustrated in enlarged form in FIG. 11A.

FIG. 11A is an enlarged section showing an abutting condition of the ink cartridge and the recovery cap in FIG. 10. The projecting contours E of the recovery caps abut onto the ink ejection opening forming surface, to define the inside of the projecting contours E as sealed space D for effectively transmitting a suction force F to ink passages 41 and an ink chamber 42.

FIG. 11B is an enlarged section showing a condition where recovery operation for filling-up ink into the ink chamber and the ink passages from the condition where the ink cartridge and the recovery cap abut. Here, for bubble J present in a condition where meniscus is formed within the ink passage 41, bubble K present in a condition blocking the ink passage, and bubble M present in unspecified size within the ink chamber 42, suction recovery operation is performed for removing these bubbles by the suction pressure F. Then, upon removal of bubbles, for the ink passages where bubble J and bubble K reside, suction has to be performed by shown acting pressures O1 to O4 in consideration of a damper effect and a meniscus force of bubbles. However, in the ink passages where no bubble is present, suction is effected even by acting pressure N much smaller than the acting pressures O1 to O4. Accordingly, by the suction recovery operation, ink is directly sucked from the ink passages where no bubble is present. From the ink passages where a bubble is present, suction of the ink is difficult. Therefore, a large amount of ink should be sucked and drained in order to remove all of bubbles.

Problems in the conventional ejection recovery system is summarized as follows.

(1) In an ink-jet printing head, an ink droplet is formed by ejecting a necessary amount of ink filled in an ink passage with rupturing a meniscus formed in an ink ejection opening. Then, when filling-up of ink into ink passages and an ink chamber is to be performed by introducing a reduced pressure within a cap sealingly covering overall an ink ejection opening forming surface, a meniscus force generated in the ink ejection opening for small opening area of the ink ejection opening associating with demand for higher quality and higher definition of image required in the recent years, becomes large to require large suction pressure.

On the other hand, when suction is performed for an ink-jet head in a condition where ink passages filled with ink and an ink passages not fully filled with ink are present in an admixing manner, loss of suction pressure due to a damper effect of air layers within the ink passage, in which ink is not fully filled, becomes significantly large. As a result, a great amount of ink is sucked unnecessarily from the ink passage which has already been fully filled with ink.

(2) On the other hand, an ink chamber supplying ink into ink passages is small and complicate in shape associating with down-sizing of an ink-jet head. Therefore, even when recovery operation by suction is performed, air in the ink chamber (hereinafter called as a bubble) is difficult to be removed. This phenomenon is a condition where a contact angle of the ink in the ink passages and the ink chamber becomes large, namely so-called wetting ability is low,. This problem is particularly significant before aging processing during ink-jet head production process or before shipping inspection printing.

(3) Moreover, in the case of an ink-jet head which can be mounted in a label printer or the like and has a long ink ejection opening array, since number of ink ejection openings is large, an ink suction amount may be increased when a damper effect is generated in a portion where ink is not fully filled.

SUMMARY OF THE INVENTION

It is a first object of the present invention to provide an ejection recovery system and method which enable an ink filling-up operation without causing residual of bubbles in an ink chamber and ink passages before aging processing during a head production process and shipping inspection printing, for an ink-jet printing head to be loaded in an ink-jet printer, plotter or the like to perform printing by ejecting ink onto a printing medium.

It is a second object of the present invention to provide an ejection recovery system which can be installed in a plotter, a large size printer or the like, in which volumes are not so limitative, in addition to use in a factory shipment process, such as aging processing and shipping inspection printing.

In the first aspect of the present invention, there is provided an ejection recovery system for a liquid ejection head including ejection openings for ejecting liquid, liquid passages communicated with the ejection openings, and ejection energy generating elements provided in the liquid passages and generating energy sufficient for ejecting the liquid, comprising:

a cover member having a cover opening for covering at least one of the ejection openings and contacting with a surface including the ejection openings of the liquid ejection head arranged for orienting the surface including the ejection openings upwardly; and suction means for generating a vacuum pressure introduced into a space defined by the cover member and the surface including the ejection openings and for performing suction from the at least one of the ejection openings covered by the cover member through the cover opening.

Here, when a diameter of a cover opening of the cover member is L1 and a length of an array of the ejection openings aligned in a row is L2, a relationship of L1<L2 may be established, and the system further comprises moving means for relatively moving the cover member and the surface including the ejection openings of the liquid ejection head in a direction of length of the array of the ejection openings. With the construction set forth above,a recovery operation can be effected only for a part of the ink ejection opening array where a recovery operation is required, concentrically.

On the other hand, an ejection recovery system may further comprises ultrasonic wave generating means for applying an ultrasonic wave to the liquid ejection head when vacuum pressure is introduced into the space defined by the cover member and the surface including the ejection openings of the liquid ejection head by the suction means. By providing the ultrasonic wave generating means, it becomes possible to grow bubbles into greater size and make bubbles to be easily released from walls of the liquid passages and the liquid chamber.

Furthermore, the liquid ejection head may be placed in an environmental atmosphere at a temperature in a range of about 35° C. to 80° C., when vacuum pressure is introduced into the space defined by the cover member and the surface including the ejection openings of the liquid ejection head by the suction means. By varying temperature environment, bubbles can be moved effectively.

On the other hand, the ejection recovery system may further comprise an energy generating element for temperature adjustment provided in the liquid passage of the liquid ejection head for adjusting the liquid at a predetermined temperature, and a temperature of the liquid ejection head is adjusted in a range of about 35° C. to 60° C. by driving the temperature adjusting energy generating element, when vacuum pressure is introduced into the space defined by the cover member and the surface including the ejection openings of the liquid ejection head by the suction means. By varying temperature environment, bubbles can be moved effectively.

Furthermore, the cover member may have flexibility. In such case, it is preferred that a material of the cover member is selected among Si type rubber and Bu type rubber. Here, rubber material containing Si is included in the Si type rubber and rubber material containing butyl group is included in Bu type rubber.

On the other hand, the ejection recovery system may further comprise monitoring means for optically monitoring a condition of the liquid passage and a liquid chamber communicated with the liquid passage in the liquid ejection head, and suction by the suction means may be performed again when the liquid passage and the liquid chamber in the liquid ejection head as monitored by the monitoring means are not filled with the liquid. By this, judgment whether re-suction is required or not can be performed per the each of liquid passages, so that re-suction can be performed locally and concentrically only for the liquid passages which have been judged as re-suction is necessary in a short period, resulting in extinguishing residual bubbles at early timing.

On the other hand, the ejection energy generating means may be a thermal energy generating element generating a thermal energy sufficient for ejecting the liquid. The temperature adjusting energy generating element may be a thermal energy generating element for generating a thermal energy sufficient for heating the liquid.

In the ejection recovery system according to the present invention constructed as set forth above, since the cover member contacting with a surface including the ejection openings of the liquid ejection head arranged for orienting the surface including the ejection openings upwardly and suction means for introducing a vacuum pressure into a space defined by the cover member and the surface including the ejection openings, the vacuum pressure is introduced into the space in a condition where bubbles presenting in the liquid passages are floating up toward the ejection openings to effectively discharge bubbles toward the clearance.

On the other hand, since a diameter of a cover opening of the cover member is L1 and a length of an array of the ejection openings aligned in a row is L2, a relationship of L1<L2 is established, suction pressure can be concentrically applied with the cover member abutting and moving along the longitudinal direction of the ink ejection opening array without being influenced by overall bubbles even if bubbles are present. Thus, it becomes possible to perform an effective recovery operation with the least necessary suction amount of the liquid without sucking and draining significantly a large amount of liquid in recovery operation to be performed before aging processing or before shipping inspection printing in the head manufacturing process. On the other hand, when the number of ejection openings is large, since an unnecessary suction amount of the liquid can be reduced, particularly effective filling up of the liquid, namely, refilling, can be performed.

It is further preferred that, assuming that a sectional area of a cover opening of the cover member is S1 and summation of areas of the ejection openings covered by the cover opening is S2, a relationship $$10{,}000 \geqq S1/S2 \geqq 10$$

is satisfied.

On the other hand, it is also preferred that, assuming a diameter of the cover opening of the cover member is L1 and a length of the array of the ejection openings aligned in a row is L2, a relationship $$1 < L2/L1 \leqq 500$$

is satisfied.

In the second aspect of the present invention, there is provided an ejection recovery method for a liquid ejection head including ejection openings for ejecting liquid, liquid passages communicated with the ejection openings, and ejection energy generating elements provided in the liquid passages and generating energy sufficient for ejecting the liquid, comprising the steps of:

arranging a surface including the ejection openings orienting upwardly;

contacting a cover member having a cover opening for covering at least one of the ejection openings onto the surface including the ejection openings of the liquid ejection head from above; and performing suction from the at least one of the ejection openings covered by the cover member through the cover opening by a vacuum pressure introduced into a space defined by the cover member and the surface including the ejection openings.

Here, assuming a diameter of a cover opening of the cover member being L1 and a length of an array of the ejection openings aligned in a row being L2, a relationship of L1<L2 is preferably be established, and the method further may comprise a step of relatively moving the cover member and the surface including the ejection openings of the liquid ejection head in a direction of length of the array of the ejection openings.

The method may further comprise a step of applying an ultrasonic wave to the liquid ejection head when vacuum pressure is introduced into the space defined by the cover member and the surface including the ejection openings of the liquid ejection head.

The method may further comprise a step of placing the liquid ejection head in an environmental atmosphere at a temperature in a range of about 35° C. to 80° C., when vacuum pressure is introduced into the space defined by the cover member and the surface including the ejection openings of the liquid ejection head.

On the other hand, the method may further comprises a step of driving an energy generating element for temperature adjustment provided in the liquid passage for adjusting a temperature of the liquid ejection head in a range of about 35° C. to 60° C., when vacuum pressure is introduced into the space defined by the cover member and the surface including the ejection openings of the liquid ejection head by the suction means.

The method may further comprise a step of optically monitoring a condition of the liquid passage and a liquid chamber communicated with the liquid passage in the liquid ejection head, and performing suction again when the liquid passage and the liquid chamber in the liquid ejection head as monitored are not filled with the liquid.

In the third aspect of the present invention, there is provided a liquid ejection printing apparatus performing printing by ejecting liquid to a printing medium from a liquid ejection head including ejection openings ejecting liquid, liquid passages communicated with the ejection openings and ejection energy generating elements provided in the liquid passages and generating energy sufficient for ejecting the liquid, comprising:

a carriage for mounting the liquid ejection head;

an ejection recovery system including a cover member having a cover opening for covering at least one of the ejection openings and contacting with a surface including the ejection openings of the liquid ejection head arranged for orienting the surface including the ejection openings upwardly and suction means for generating a vacuum pressure introduced into a space defined by the cover member and the surface including the ejection openings and for performing suction from the at least one of the ejection openings covered by the cover member through the cover opening; and changing means for changing a direction of the carriage for orienting the surface including the ejection openings of the liquid ejection head upwardly.

Here, when a diameter of a cover opening of the cover member is L1 and a length of an array of the ejection openings aligned in a row is L2, a relationship of L1<L2 may be established, and the system further comprises moving means for relatively moving the cover member and the surface including the ejection openings of the liquid ejection head in a direction of length of the array of the ejection openings.

On the other hand, an ejection recovery system may further comprises ultrasonic wave generating means for applying an ultrasonic wave to the liquid ejection head when vacuum pressure is introduced into the space defined by the cover member and the surface including the ejection openings of the liquid ejection head by the suction means.

Furthermore, the liquid ejection head may be placed in an environmental atmosphere at a temperature in a range of about 35° C. to 80° C., when vacuum pressure is introduced into the space defined by the cover member and the surface including the ejection openings of the liquid ejection head by the suction means.

On the other hand, the ejection recovery system may further comprise an energy generating element for temperature adjustment provided in the liquid passage of the liquid ejection head for adjusting the liquid at a predetermined temperature, and a temperature of the liquid ejection head is adjusted in a range of about 35° C. to 60° C. by driving the temperature adjusting energy generating element, when vacuum pressure is introduced into the space defined by the cover member and the surface including the ejection openings of the liquid ejection head by the suction means.

As set forth above, in accordance with the present invention, by abutting and sucking the liquid ejection opening forming surface of the liquid ejection head oriented upwardly, from the above by the elastic member provided with the suction hole, bubbles residing within the liquid passages and floating up to the ejection openings can be effectively sucked out.

On the other hand, by making the internal diameter of the suction hole of the elastic member smaller than the length of the ejection opening array, a part of the ejection opening array can be concentrically sucked to omit suction operation for the ejection openings which do not require recovery.

Furthermore, by relatively moving the elastic member and the ejection opening array, even if bubbles are present, it becomes possible to concentrically apply the suction pressure without being influenced by all of bubbles. Therefore, an effective recovery can be performed with the least necessary ink suction amount without sucking and draining a significantly large amount of ink during a recovery operation before aging processing or before shipping inspection printing in the ink-jet head manufacturing process.

On the other hand, when the number of the ejection openings is large, particularly effective ink filling up can be performed for reduction of an unnecessary ink suction amount.

Furthermore, the ejection recovery system according to the present invention is applicable not only for pre-factory shipment process, such as aging processing or shipping inspection printing, but also as the ejection recovery system to be mounted in a plotter, a large size printer or the like which has smaller constraint in a size of a main body to prevent user from draining unnecessarily a large amount of the ink and thus to contribute for ecology.

The above and other objects, effects, features and advantages of the present invention will become more apparent from the following description of embodiments thereof taken in conjunction with the accompanying drawings.

BRIEF DESCRIPTION OF THE DRAWINGS

FIGS. 2A and 2B show a construction of an elastic member to be used in the ejection recovery system shown in FIG. 1, wherein FIG. 2A is a plan view and FIG. 2B is a longitudinal section take along line IIB—IIB of FIG. 2A;

FIGS. 3A and 3B show an ink-jet printing head in an ink cartridge which is effected with a recovery operation by the ejection recovery system shown in FIG. 1, wherein FIG. 3A is a plan view showing an ink ejection opening forming surface, and FIG. 3B shows a plan view showing the ink ejection opening forming surface in enlarged form;

FIGS. 5A and 5B show another embodiment of the elastic member in the present invention, wherein FIG. 5A is a bottom view and FIG. 5B is a longitudinal section;

FIGS. 6A and 6B show a further embodiment of the elastic member in the present invention, wherein FIG. 6A is a bottom view and FIG. 6B is a longitudinal section;

FIGS. 7A and 7B show a still further embodiment of the elastic member in the present invention, wherein FIG. 7A is a bottom view and FIG. 7B is a longitudinal section;

FIGS. 8A and 8B show a yet further embodiment of the elastic member in the present invention, wherein FIG. 8A is a bottom view and FIG. 8B is a longitudinal section;

FIGS. 9A and 9B show a recovery cap to be used in the recovery operation of the conventional inkjet printing head, wherein FIG. 9A is a plan view of a recovery cap and FIG. 9B is a section taken along line IXB—IXB of FIG. 9A;

DETAILED DESCRIPTION OF THE PREFERRED EMBODIMENT

Preferred embodiments of the present invention will be described hereinafter in detail with reference to the accompanying drawings.

It should be noted that a liquid in the present invention includes an ink which is not in liquid state under a normal temperature and becomes liquid state as heated, in addition to a liquid state ink containing a pigment or the like. Hereinafter, the foregoing liquid will be referred to as ink for the purpose of disclosure. On the other hand, the term "recovery" is used in the meaning of not only filling ink (liquid) into ink passages or the like before shipping, but also "recovering" at the time when the ink-jet printing head is loaded on a printer or the like.

(First Embodiment)

Figure 1:
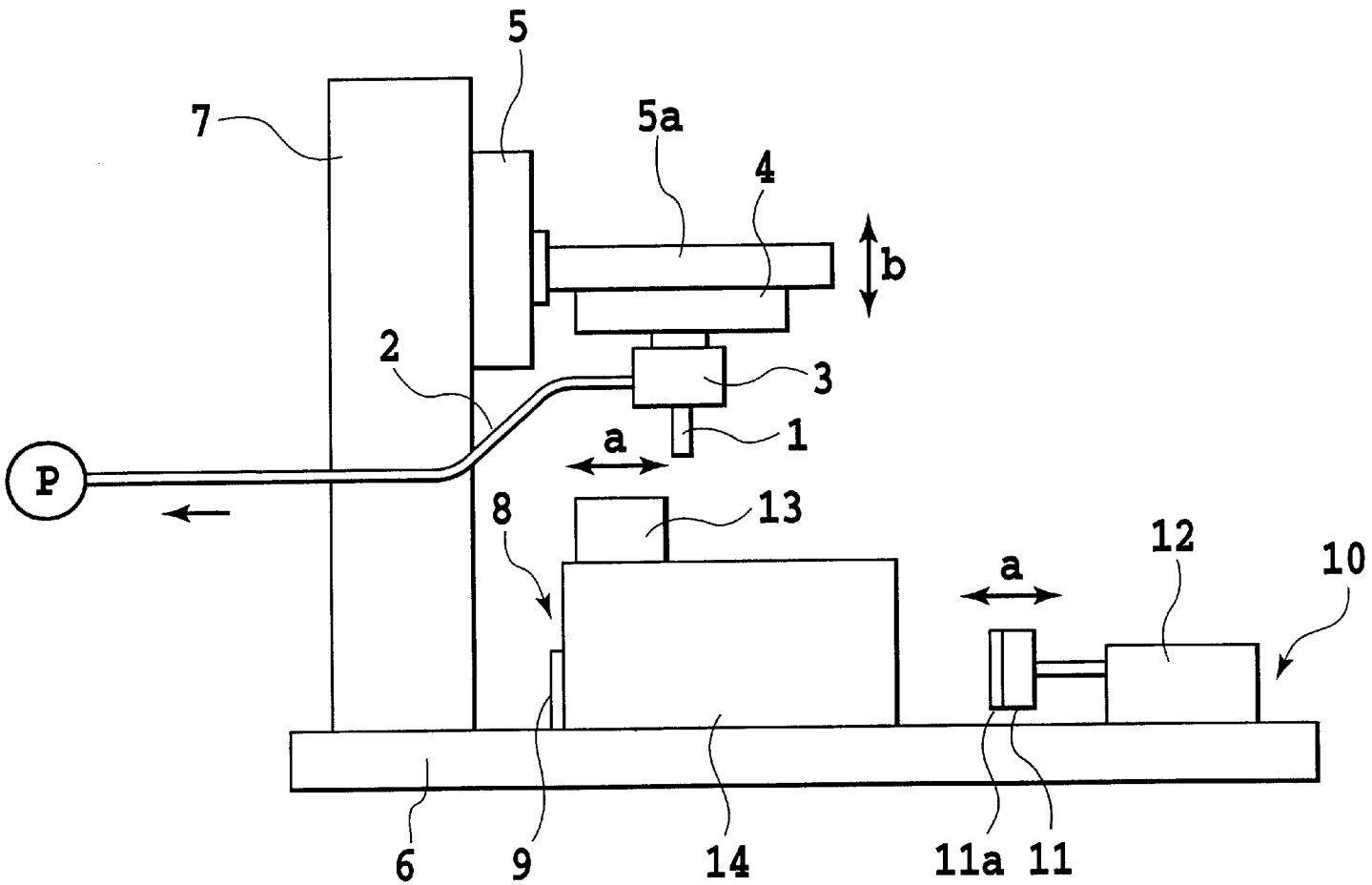
FIG. 1 is a general front elevation showing one embodiment of an ejection recovery system according to the present invention.
Figure 2A:
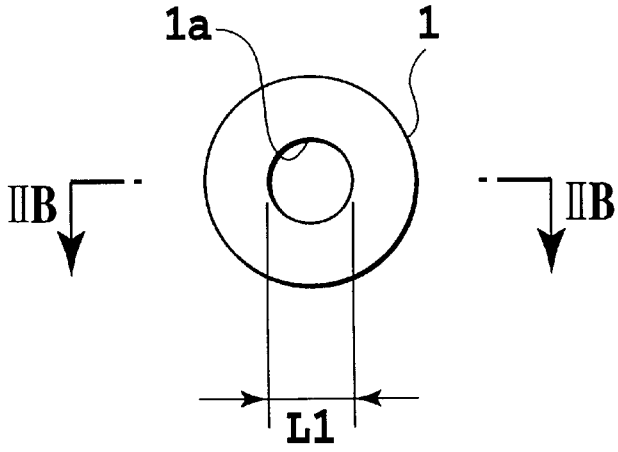
Figure 2B:
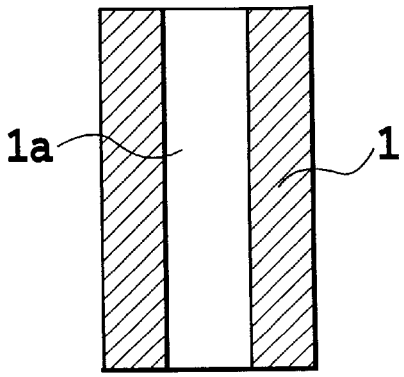
Figure 3A:
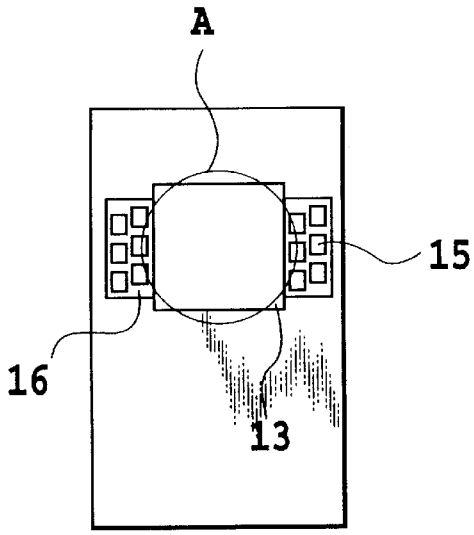
Figure 3B:
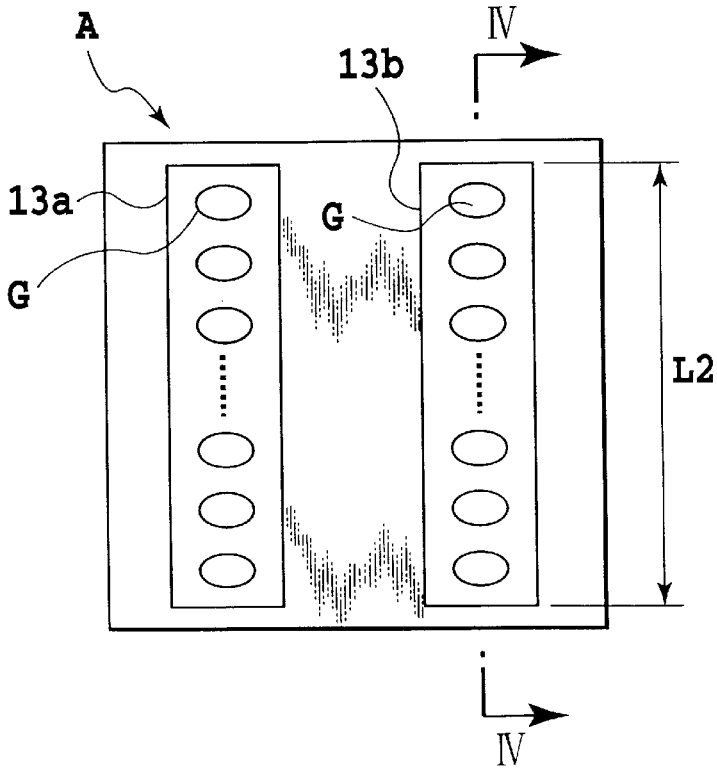
Figure 4:
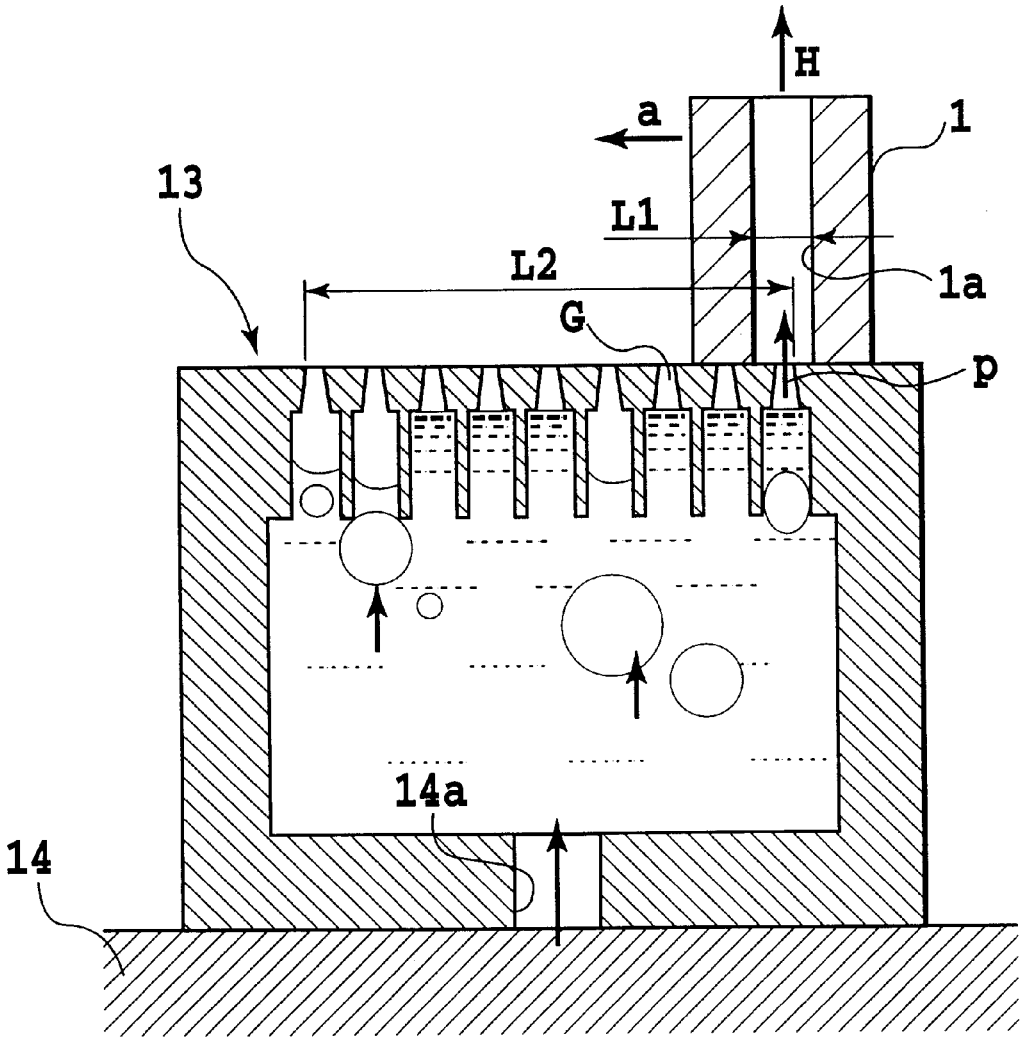
FIG. 4 is a section showing a condition of ejection recovery operation using an elastic member for the ink-jet printing head in a longitudinal section taken along line IV—IV of FIG. 3B.

FIG. 1 is a general front elevation showing one embodiment of an ejection recovery system according to the present invention. FIGS. 2A and 2B show a construction of an elastic member to be employed in the ejection recovery system shown in FIG. 1, wherein FIG. 2A is a plan view and FIG. 2B is a longitudinal section take along line IIB—IIB of FIG. 2A. FIGS. 3A and 3B show an ink-jet printing head in an ink cartridge which is effected recovery operation by the ejection recovery system shown in FIG. 1, wherein FIG. 3A is a plan view showing an ink ejection opening forming surface and FIG. 3B shows a plan view showing the ink ejection opening forming surface in enlarged form. FIG. 4 is a section showing a condition of ejection recovery operation using the elastic member for the ink-jet printing head in a longitudinal section taken along line IV—IV of FIG. 3B. It should be noted that a power source, a personal computer, a driver, a stage control board necessary for forming the shown embodiment are omitted for clarity.

In FIGS. 1, 2A, 2B and 4, reference numeral 1 denotes a hollow cylindrical cover member (cap or elastic member) formed of a rubbery flexible material, such as silicone rubber or butyl rubber. Within the elastic member 1, a cover opening (suction hole) 1*a* having an internal diameter L1 is formed. The elastic member 1 is fixed to an elastic member fixing block 3 at an upper end thereof. The suction hole 1*a* of the elastic member 1 is connected to a suction pump P forming a part of suction means, via a passage formed in the elastic member fixing block 3 and a tube 2 communicated with the passage in the elastic member fixing block 3. By the suction pump P, an ink containing bubbles on the side of a head sucked up to the elastic member 1 can be drained to a waste ink holder (not shown) via the tube 2. It should be noted that a length of the elastic member 1 in a longitudinal direction is determined at a length permitting fixing by the elastic member fixing block 3 of FIG. 1, and permitting deflection without causing damage on a ink ejection opening-forming surface A, upon movement along an ink ejection opening array direction with contacting on the ink ejection opening forming surface A.

The elastic member fixing block 3 is fixed on an X stage 4 which is reciprocally movable in directions of arrow a. The X stage 4 is fixed on an arm 5*a* of a Z stage 5 which is reciprocally movable in directions of arrow b. The Z stage 5 is fixed at a side of a stage fixing plate 7 installed vertically on a base 6. On an upper surface of the base 6, a positioning member 9 for positioning an ink-jet cartridge 8 which will be explained later and is subject to an ejection recovery operation by suction means generally constructed with the elastic member 1, the tube 2 and the suction pump P, is provided. On the other hand, on the upper surface of the base 6, loading means 10 arranged on an extension in the direction of arrow a together with the positioning member 9 for securing the ink-jet cartridge 8 positioned by the positioning member 9. The loading means 10 is generally constructed with a holding member 11 pushing a side wall portion of the ink-jet cartridge 8 and an air cylinder 12 driving the holding member 11 back and forth in the direction of arrow a. On the holding member 11, a depressing surface member 11*a* formed of an elastic member is provided for preventing the side wall portion of the ink-jet cartridge 8 from causing deformation or so on due to depression.

The ink-jet cartridge 8 can be detachably loaded on a carriage of the ink-jet printing apparatus (not shown) as a liquid ejecting apparatus and is constructed by integrating an ink-jet printing head 13 as a liquid ejection head and an ink tank 14 storing the ink as a liquid supplied to the ink-jet printing head 13 via a supply opening 14*a*. Here, in FIG. 3A, reference numeral 15 denotes contact pads for transmitting an electric signal or drive voltage information from a main body (not shown) of the ink-jet printing apparatus when the ink-jet cartridge 8 is loaded on the carriage, and 16 is a flexible cable, on which the contact pads 15 are arranged.

With the construction set forth above, the lower end portion of the elastic member 1 which is movable in X direction (direction of arrow a) and Z direction (direction of arrow b) contacts with the ink ejection opening forming surface A, shown in FIGS. 3A and 3B and is movable along the ink ejection opening forming surface A.

Here, one example of the ink ejection opening forming surface A, will be explained with reference to FIG. 3B.

The ink ejection opening forming surface A in the shown embodiment has two rows of ink ejection opening arrays 13*a* and 13*b*. In both ink ejection opening arrays, a plurality of ink ejection openings G are formed in the same pitch. A plurality of ink ejection openings G in one of the ink ejection opening arrays are offset in a direction along the ink ejection opening array for a half pitch relative to a plurality of ink ejection openings G in the other ink ejection opening array, and arrangement density of the ejection openings is set to be double of number of the ink ejection openings of the ink ejection opening array on one side. Lengths of both ink ejection opening arrays are set at L2 which is greater than a diameter L1 of the suction hole 1*a* of the elastic member 1. These ink ejection opening arrays 13*a* and 13*b* are extended in the direction of arrow a of FIGS. 1 and 4.

Ejection recovery operation in the shown embodiment will be explained hereinafter with reference to FIGS. 1 to 4.

At first, the ink-jet cartridge 8 is mounted on the upper surface of the base 6 and abuts onto the positioning member 9 to position the ink-jet printing head 13 below the elastic member 1 with orienting the ink ejection opening forming surface A upwardly. Next, by means of the air cylinder 12, the holding member 11 is pushed out to fix the ink-jet cartridge 8 on the upper surface of the base 6 by pushing the side wall portion of the positioned ink-jet cartridge 8.

Next, by driving the X stage, 4 and the Z stage as required, the lower end portion of the elastic member 1 is abutted onto the end portions of the ink ejection opening arrays 13*a* and 13*b* of the ink ejection opening forming surface A of the ink-jet printing head 13, as shown in FIG. 4. Subsequently, by driving the X stage 4 to move in, X direction (direction of arrow a), the lower end portion of the elastic member 1 is sequentially abut onto the ink ejection openings aligned in a row.

Figure 18A:
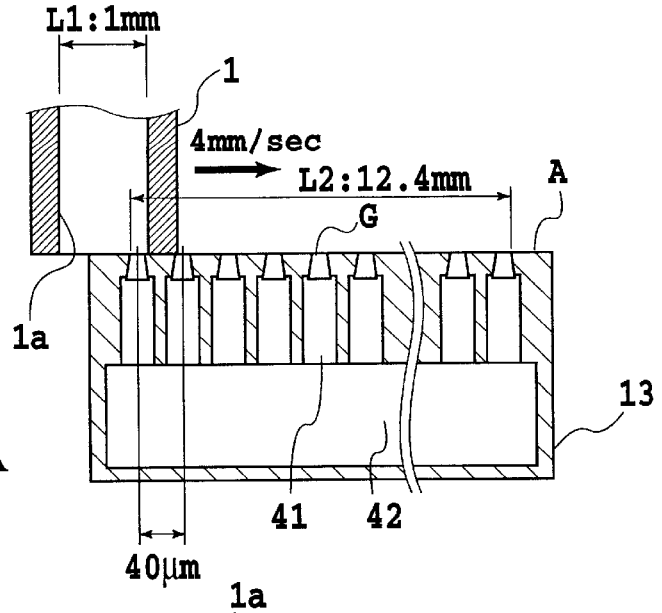
FIGS. 18A to 18C are sections showing a behavior of motion of an elastic member relative to the ink-jet printing head.
Figure 18B:
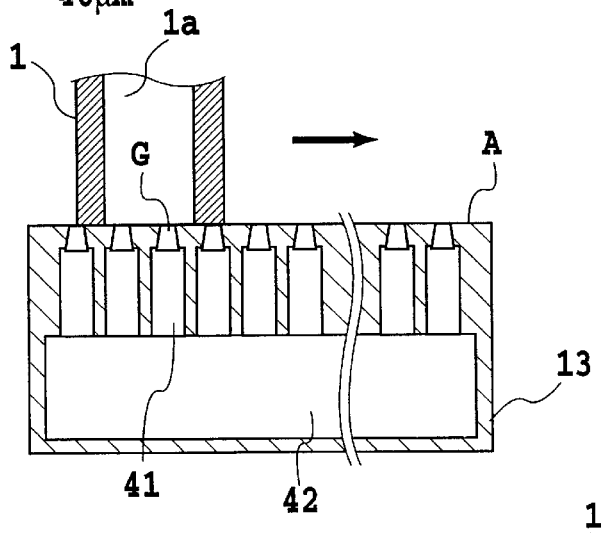
Figure 18C:
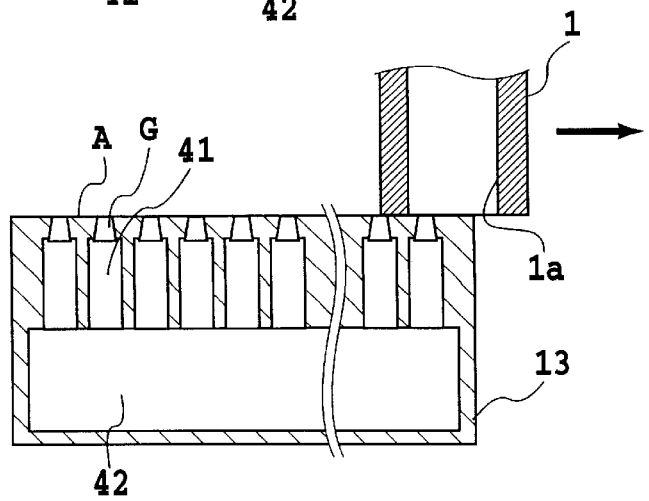
Figure 19:
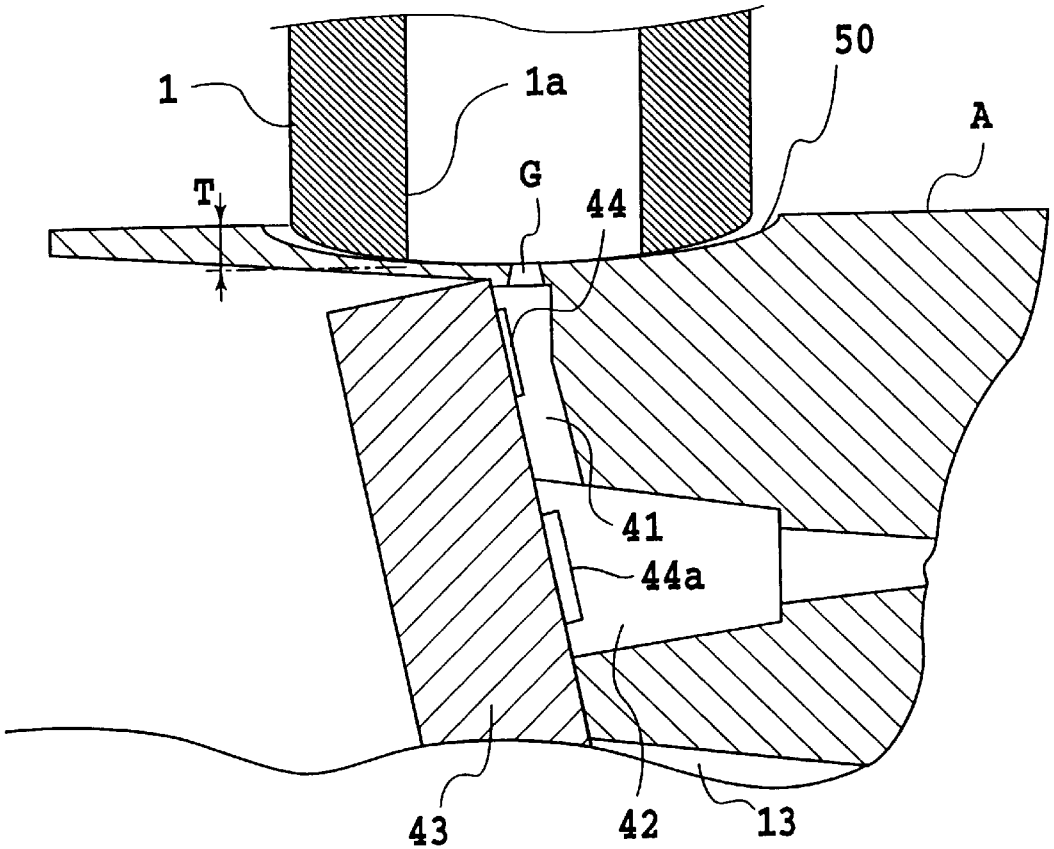
FIG. 19 is a section showing a detail of abutting condition of the elastic member relative to the ink-jet printing head.
Figure 20A:
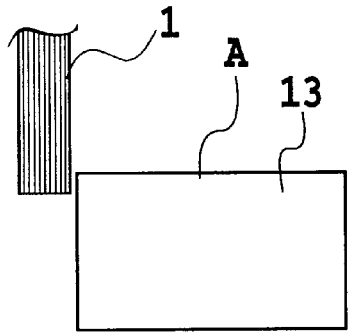
FIGS. 20A to 20C are side elevations showing a behavior of motion of the elastic member relative to the ink-jet printing head.
Figure 20B:
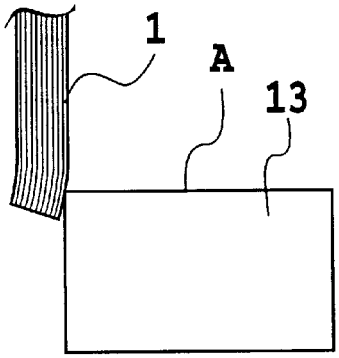
Figure 20C:
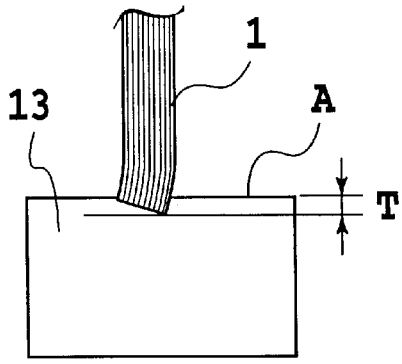

Abutting of the elastic member 10 onto the ink ejection opening forming surface A and movement will be explained in greater detail with reference to FIGS. 18 to 20. Behavior of the lower end portion of the elastic member 1 moving with sequentially sliding on the ink ejection openings aligned in row is illustrated in FIGS. 18A to 18C and 20A to 20C. On the other hand, further particular sectional shape of the ink ejection opening forming surface A is illustrated in FIG. 19, in which a recessed portion 50 having a maximum depth T and being arranged ink ejection openings G aligned in a row in the center thereof (in the drawing, for the reason of position of the section, only ink ejection openings included in the ink ejection opening array on one side are illustrated), is continuously formed along the ink ejection opening array. A width of the recessed portion 50 is slightly greater than a diameter of the elastic member 1. In practice, the lower end of the elastic member 1 rubbingly moves in contact with the recessed portion 50. It should be appreciated that in FIG. 19, reference numeral 43 denotes a substrate, 44 denotes a heater as an ejection energy generating element.

On the elastic member 1, a force associated with abutting and moving is exerted, so that the lower end of the elastic member is deformed in a form to be firmly fitted to the shape of the ink ejection opening surface as shown in FIG. 19. This deformation contributes improvement in a firm fitting ability with the ink ejection opening forming surface A to make recovery by suction efficient. It should be noted that as shown in sequential order in FIGS. 20A to 20C, before abutting with the ink-jet printing head 13, the elastic member 1 is maintained in straight position (FIG. 20A), upon abutting, the lower end of the elastic member 1 is deflected slightly (FIG. 20B), and upon moving within the recessed portion 50 having the maximum depth T with sequentially sliding the ink ejection openings aligned in the row in sequential order (FIG. 20C), a magnitude of deflection of the elastic member 1 is maintained substantially as is. On the rear side of the direction of motion of the elastic member 1, a small clearance is formed between the suction hole 1*a* of the elastic member 1 and the ink ejection opening forming surface A (bottom surface of the recessed portion 50). However, this clearance is not so large as causing adverse effect for suction operation through the ink ejection openings G. Rather, the clearance may serve for assisting smooth movement of the elastic member In the case of the shown embodiment of the ink-jet printing head 13, the three hundreds ten ink ejection openings G are arranged per ink ejection opening array at a pitch of 40 $\mu$m. Accordingly, the length L2 of the ink ejection opening array is 12.4 mm. Preferred diameter of the suction hole 1*a* of the elastic member 1 is 1 mm. Therefore, in the condition shown in FIG. 18B, while number of ink ejection openings simultaneously mating with the suction hole 1*a* of the elastic member 1 is conceptually shown, twenty-five ink ejection openings should mate simultaneously with the suction hole 1*a* in practice. Assuming that relative motion speed of the elastic member 1 is set at 4 mm/sec, for example, necessary period for suction recovery operation for all of the ink ejection openings would be approximately 4 seconds.

Upon setting of the motion speed, it should be considered that while low motion speed is effective for recovery operation, unnecessarily large amount of ink should be sucked to increase ink amount to be disposed. Furthermore, a relationship between effective sectional area of the suction hole 1*a* of the elastic member 1 and total sectional area of the ink ejection openings to be simultaneously included in the effective sectional area of the suction hole 1*a* and a relationship between the diameter of the suction hole 1*a* of the elastic member 1 and the length of the ink ejection opening array are considered for optimally setting the motion speed.

Therefore, the relationship between effective sectional area of the suction hole 1*a* of the elastic member 1 and total sectional area of the ink ejection openings to be simultaneously included in the effective sectional area of the suction hole 1*a* is preferred to satisfy the following expression, assuming that the sectional area of the suction hole 1*a* of the elastic member 1 is S1 and the summation of the area of the ink ejection openings G covered with the suction hole 1*a* is S2:

$$10{,}000 \geqq S1/S2 \geqq 10$$

It is preferable that S1/S2 is less than or equal to 10,000 in view of efficiency of sucking and S1/S2 is more than or equal to 10 in view of assurance of sucking.

On the other hand, a relationship between the diameter of the suction hole 1*a* of the elastic member 1 and the length of the ink ejection opening array is preferred to satisfy the following expression, assuming that the diameter of the suction hole 1*a* of the elastic member 1 is L1 and the length of the array of the ink ejection openings G aligned in a row is L2:

$$1 < L2/L1 \leqq 500$$

It is preferable that L2/L1 is more than 1 in view of assurance of sucking and L2/L1 is less than or equal to 500 in view of efficiency of sucking.

It should be noted that when the sectional area of the ink ejection opening is quite fine and/or when the structure of the ink ejection opening is difficult to recover for large pressure loss, the elastic member 1 may be reciprocated for several times as required.

Upon motion of the foregoing elastic member 1, the suction pump P forming a part of the foregoing suction means is driven to generate a vacuum pressure (negative or less pressure than atmospheric pressure) introduced into the sealed space defined by the elastic member 1 and the ink ejection opening forming surface A oriented upwardly via the elastic member 1 and the tube 2 or the like, to sequentially suck not only the ink but also bubbles residing in the ink or floating up to the ink ejection opening, from the ink ejection opening G. By removing bubbles, filling-up of the ink (refill) for the ink passages communicated with the ink ejection openings G can be performed effectively in a short period. The ink-jet cartridge 8 can be adapted for high speed printing. It should be noted that the suction pump P to be used here is preferred to perform recovery operation with maintaining the suction pressure constant. Therefore, as the suction pump P, a tube pump, a gear pump, syringe pump and so on may be used.

On the other hand, since the diameter L1 of the suction hole 1*a* of the elastic member 1 is set to be smaller than the length L2 of the ink ejection opening array, only ink ejection openings at necessary portion can be concentrically sucked to prevent loss of suction pressure H as shown in FIG. 4. As a result of low suction pressure loss by concentric suction, it becomes not extremely necessary to achieve high fitting ability between the ink ejection opening forming surface and the elastic member which is inherent conventionally. In the present invention, slight leakage between the ink ejection opening forming surface and the elastic member is permitted.

Furthermore, since the diameter L1 of the suction hole 1*a* of the elastic member 1 is shorter than the length L2 of the ink ejection opening array, even if bubble is present, it may not be influenced by all bubbles to permit concentrically apply a force P greater than action pressure N and O1 to O4 to perform effective recovery operation without sucking and draining extra amount of ink.

On the other hand, since the ink ejection opening forming surface is oriented upwardly as shown in the condition where recovery operation is performed, bubbles in the ink passages and the ink chamber can be easily moved in the suction direction.

In order to effectively move bubbles, it may be preferred to add a mechanism for applying ultrasonic wave to the ink-jet printing head, warming the ink-jet printing head, for example, for expanding bubbles and whereby easily releasing bubbles from the ink passages and the ink chamber.

It should be noted that when the ink-jet printing head is warmed, bubbles can be effectively moved by placing the overall ejection recovery system in an environmental atmosphere at a temperature in a range of about 35° C. to 80° C., or setting the temperature of the ink-jet printing head at about 35° C. to 60° C. by driving an energy generating element of the ink-jet printing head for temperature adjustment.

On the other hand, by adding a mechanism permitting optically monitoring a condition of the ink chamber after conducting suction recovery, a certain recovery operation may be performed by effecting suction again when ink is not fully filled. In order to permit optical monitoring of the ink chamber, the wall member of the ink chamber or the like may be formed of a transparent material, and light is irradiated through the wall member to make judgment between the condition where the ink is filled and the condition where the ink is not filled based on difference of light reflection or light absorption. On the other hand, it is also possible to monitor the internal condition of the ink chamber or the like by irradiating an electromagnetic wave, such as X-ray or the like and by performing image processing of a reflected wave.

On the other hand, in the case of the ink-jet printing head having a quite large number of ink ejection openings, the recovery cap sealingly covering all of the ink ejection openings as required conventionally, also becomes quite bulky. Furthermore, high fitting ability between the recovery cap and the ink-jet printing head is required. However, when the diameter L1 of the suction hole is shorter than the length L2 of the ink ejection opening array in the present invention, recovery becomes possible without requiring high fitting ability irrespective of number of ink ejection openings by the effective action of the suction pressure. As a result, the ink amount to be sucked and drained can be significantly reduced.

(Second Embodiment)

Figure 12:
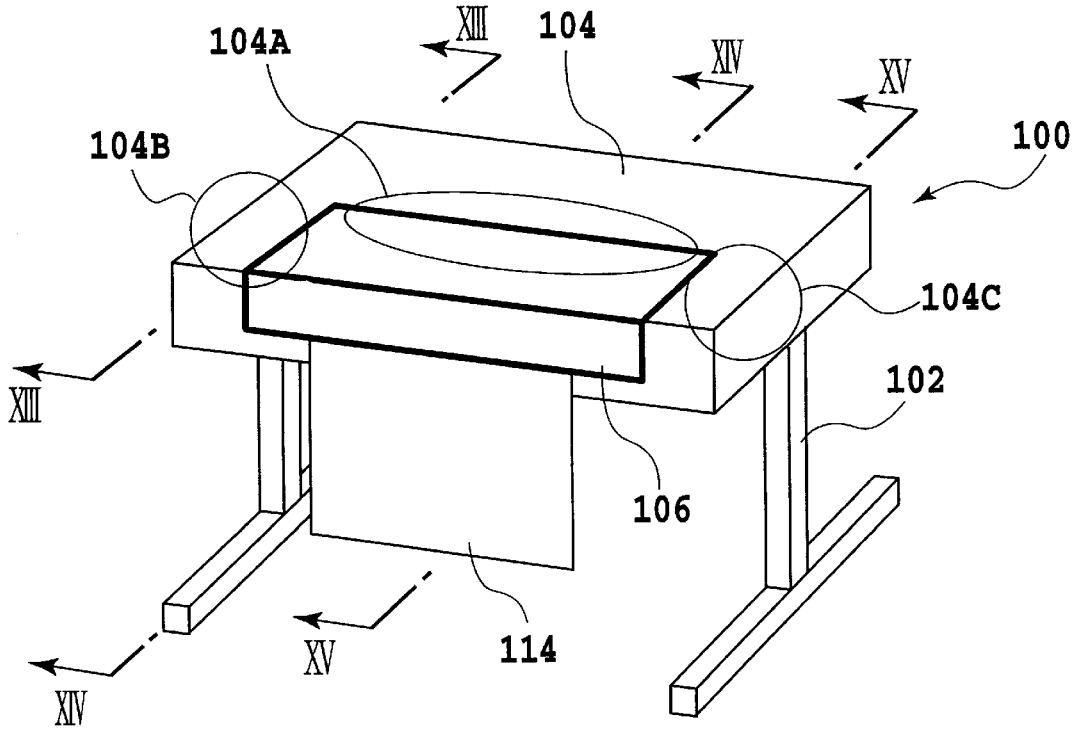
FIG. 12 is a perspective view showing one example of a large size ink-jet printer, namely a plotter 100, to which the ejection recovery system according to the present invention is applied.

FIG. 12 is a perspective view showing one embodiment of a large size ink-jet printer, namely a plotter 100, in which the ejection recovery system according to the present invention is built-in. The ink-jet printer 100 has a generally rectangular parallelepiped casing 104 supported on stands 102. A cover 106 which can be opened and closed, is provided at the center of front portion of the casing 104.

Within the casing 104, a guide shaft 108 extending in a lateral direction is provided as is well known in the art so as to guide a carriage 110 reciprocally on which a cartridge 113 including an ink-jet printing head 112 is mounted. In FIG. 12, a central region 104A of the casing 104 is a printing region by the ink-jet printing head 112, a left side region 104B is a region for receiving the ink-jet printing head 112 when a printing signal is not present, which region 104B includes a home position of the ink-jet printing head 112. On the other hand, a right side region 104C is a region to perform recovery of the ink-jet printing head 112 on the basis of a sequence command from a not shown controller or a command selectively input by a user, which region 104C includes a cleaning position. It should be noted that, in the shown embodiment, while the home position and the cleaning position are arranged on opposite sides of the casing, it is possible to arrange both of the home position and the cleaning position on one side of the casing in parallel relationship with each other. In the shown embodiment, a printing medium 114 is ejected from a front face of the plotter 100 through a clearance located at a lower edge portion of the cover 106.

Next, conditions of the ink-jet printing head 112 in respective of the left side region 104B, the central region 104A and the right side region 104C in the casing 104 will be explained.

Figure 13:
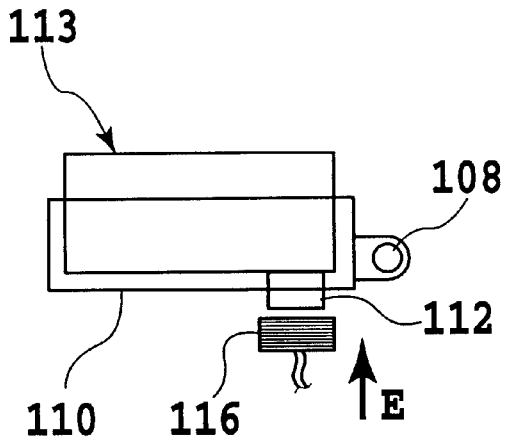
FIG. 13 is a section taken along line XIII—XIII of FIG. 12 showing a condition where the ink-jet printing head 112 is housed in a home position.

FIG. 13 is a section taken along line XIII—XIII of FIG. 12 showing a condition where the ink-jet printing head 112 is housed. In the housed condition, a protection cap 116 is elevated in a direction of arrow E to seal the ink ejection opening forming surface of the ink-jet printing head 112 to prevent evaporation of the ink. Here, the ink-jet printing head 112 is fixed on the carriage 110 which is slidably guided by the guide shaft 108. The carriage 110 is locked so as not to move as depressed in the direction of arrow E by the protection cap 116.

Figure 14:
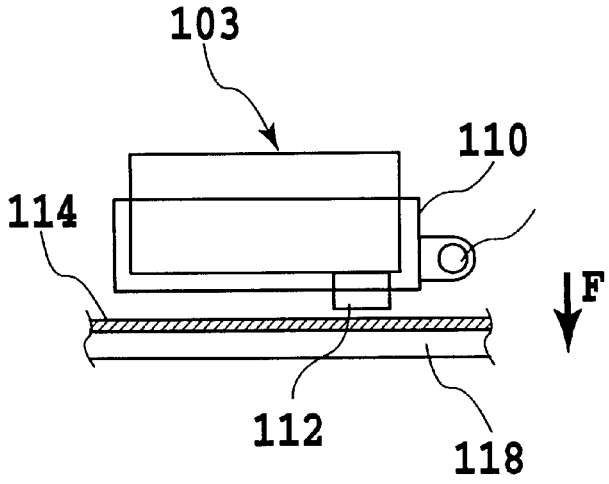
FIG. 14 is a section taken along line XIV—XIV of FIG. 12 showing a condition where the ink-jet printing head 112 is in printing operation.

FIG. 14 is a section taken along line XIV—XIV of FIG. 12, showing a condition where the ink-jet printing head 112 is placed in the printing condition. The ink-jet printing head 112 forms an image on the printing medium 114 mounted on the platen 118 by ejecting the ink in the direction of arrow F with moving along the guide shaft 108.

Figure 15:
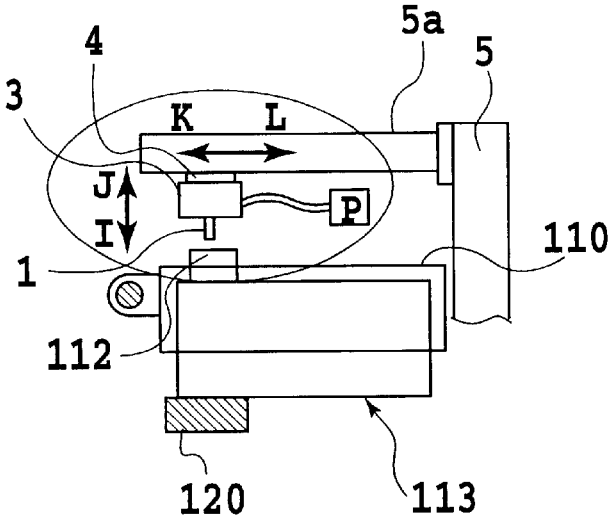
FIG. 15 is a section taken along line XV—XV of FIG. 12 showing a condition at a cleaning position where recovery operation of the ink-jet printing head 112 is performed.
Figure 16:
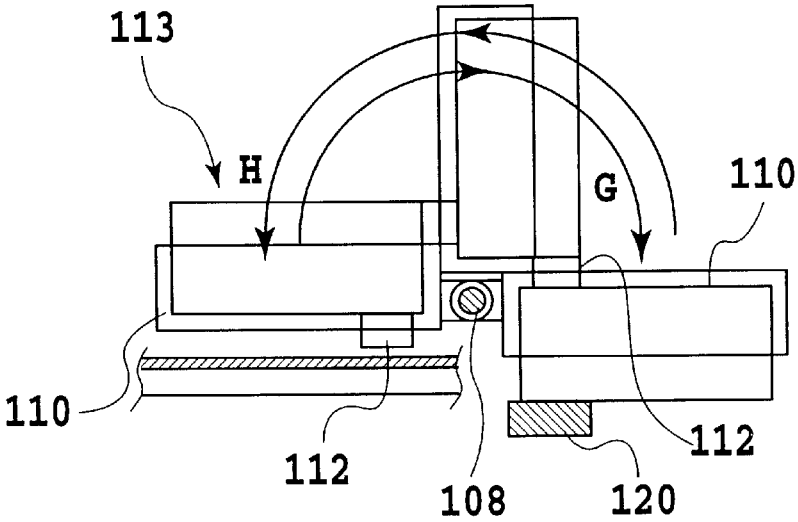
FIG. 16 is a side elevation for explaining an operation of a carriage reversing mechanism.

FIG. 15 is a section taken along line XV—XV of FIG. 12 and showing a condition to perform recovery operation of the ink-jet printing head 112 at the cleaning position for performing recovery operation. It should be noted that the carriage 100 is moved from a printing condition where the ink-jet printing head 112 is oriented downwardly to the cleaning position in response to input of a recovery operation signal. In the plotter 100 according to the present invention, a carriage reversing mechanism (not shown) which is driven by a motor, is provided to change a direction of the carriage 110 by reversing the carriage 110 over 180° about the guide shaft 108 as shown in FIG. 16 at the cleaning position or before reaching the cleaning position. Then, an upper surface of the ink-jet cartridge comes into contact with a stopper 120 which is formed of a shock absorbing material, such as a silicon rubber or the like. Thus, the carriage is held in a condition, in which the ink ejection opening forming surface of the ink-jet printing head 112 is oriented upwardly.

By providing such a carriage reversing mechanism, the home position and the cleaning position can be provided on the back side of the printing region instead of left and right sides of the printing region as set forth above. This contributes for down-sizing of the plotter 100 and thus for space saving.

In FIG. 15, since the ejection recovery system has the basic construction the same as the former embodiment, like components are identified by like reference numerals for avoiding redundant disclosure to keep the disclosure simple enough to facilitate clear understanding of the present invention. For the ink-jet printing head 112 maintained in a condition where the ink ejection opening forming surface is oriented upwardly, by the stopper 120, the elastic member 1 is lowered in a direction of arrow I to abut the lower end portion thereof onto the ink ejection opening surface. Subsequently, pressure within the suction hole 1*a* of the elastic member 1 is reduced into vacuum condition by the suction pump P to perform suction operation with moving the elastic member 1 in a direction of arrow K or a direction of arrow L. After completing predetermined suction operation, the elastic member 1 is elevated in a direction of arrow J to terminate suction operation. After completion of such suction operation, the carriage reversing operation is operated again to pivot the carriage in a direction of arrow H shown in FIG. 16 to return the ink-jet printing head 112 to the printing position to complete recovery operation.

It should be noted that, in the shown embodiment, the following effect can be obtained by providing the carriage reversing mechanism. Namely, by an impact upon stabilization after pivoting in the direction of arrow G before suction, bubbles adhering on the inner wall or the like of the ink chamber of the ink-jet printing head 112 and residing within the ink chamber is released to flow toward the ink ejection openings which can be easily sucked. Furthermore, by an impact upon stabilization after pivoting in the direction of arrow H after suction recovery, bubbles on the side of the ink ejection openings are moved toward the ink chamber which does not influence for ejection even if any bubbles reside.

Figure 17:
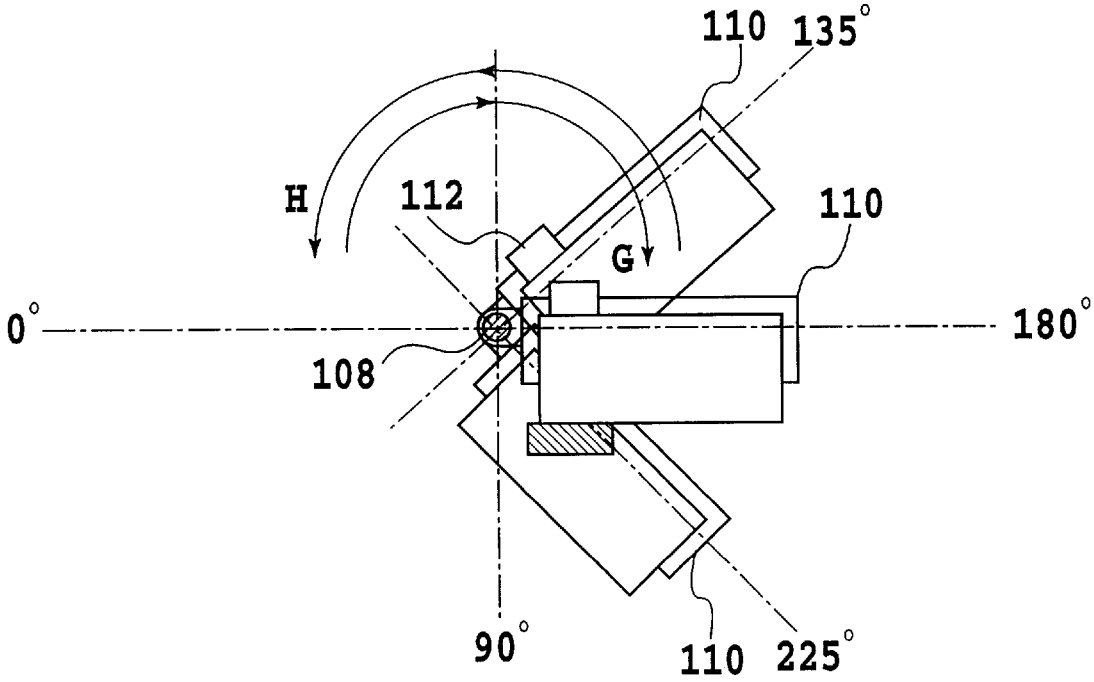
FIG. 17 is a side elevation showing a pivoting range which the ink-jet printing head can take.

As set forth above, the plotter of the shown embodiment orients the ink ejection openings downwardly which is optimal for ejection in a normal printing state and upwardly which is optimal for suction in recovery operation. Therefore, good recovery condition can be attained. As an example where the ink ejection openings are oriented upwardly, an example where the orientation of the ink ejection opening forming surface is reversed over 1800, is shown in FIGS. 15 and 16. However, the pivoting range may be about 135° to 225° as shown in FIG. 17.

(Other Embodiments)

Next, other example of the elastic member 1 according to the present invention will be explained with reference to the drawings. Here, the elastic member 1 to be explained hereinafter is applicable for the former first and second embodiments. Each of following elastic members 1 shows other embodiment of the ejection recovery system according to the present invention, as is.

Figure 5A:
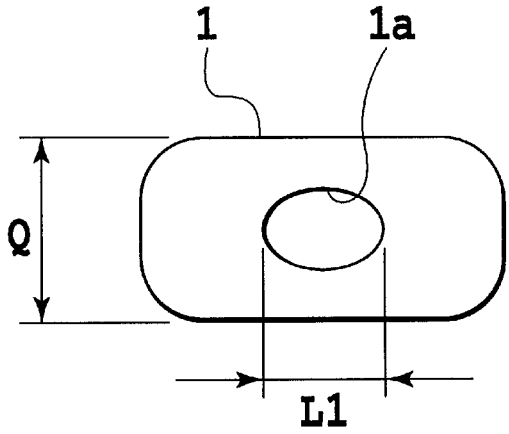
Figure 5B:
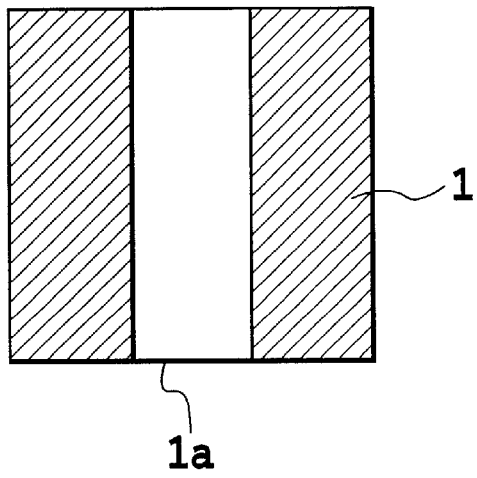

FIGS. 5A and 5B show the embodiment, in which a contact surface of the elastic member 1 mating with the ink ejection opening forming surface is generally rectangular, and the ink suction hole 1*a* is elliptic. In this case, assuming that an internal diameter L1 of the suction hole 1*a* is a longer diameter of elliptic, in order to move with abutting onto the ink ejection opening forming surface and sucking the ink without damaging the ink ejection openings, it is preferred to move the elastic member 1 in a direction Q for high deflection ability.

Figure 6A:
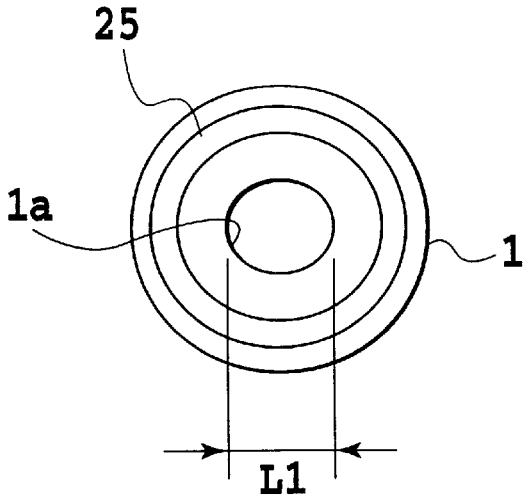
Figure 6B:
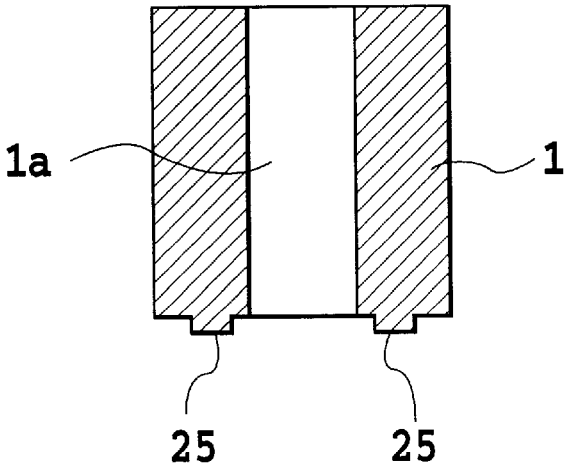

FIGS. 6A and 6B show the embodiment which has the ink suction hole 1*a* which has a circular contact surface of the elastic member 1 mating with the ink ejection opening forming surface and has an internal diameter L1. On the other hand, in order to improve fitting ability with the ink ejection opening forming surface, an annular projection 25 is provided at the tip end of the elastic member 1. The elastic member 1 is moved with sealingly fitting the annular projection 25 onto the ink ejection opening forming surface with sucking the ink. Due to no direction dependency of deflection ability for circular shape of the elastic member 1, there is no restriction in direction of motion, namely in the direction for mounting the elastic member 10 on the system.

Figure 7A:
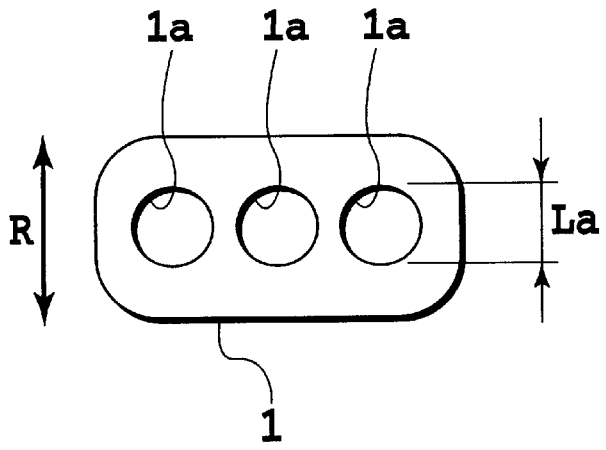
Figure 7B:
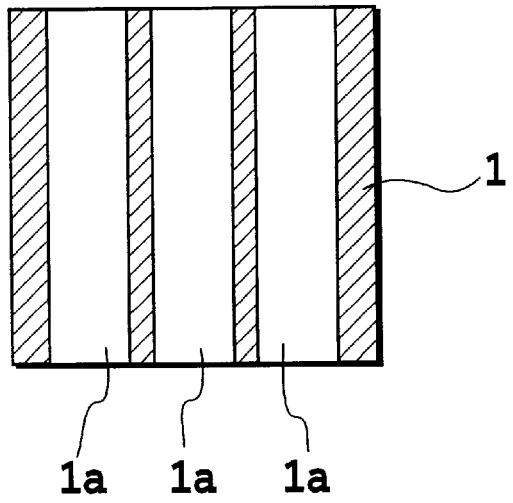

FIGS. 7A and 7B show the embodiment, in which a contact surface of the elastic member 1 mating with the ink ejection opening forming surface is generally rectangular, and the ink suction hole 1*a* is divided into three fractions. It is preferred to move the elastic member 1 in a direction R for high deflection ability. Also, by dividing the ink suction hole 1*a* into three fractions in a direction perpendicular to motion direction, required precision of contact with the ink ejection opening can be reduced. In this case, number of suction holes consisting the length L1 of the suction hole 1*a* can be any number. However, it should be considered that when the size of diameter of the suction hole becomes smaller, pressure loss upon suction becomes large.

Figure 8A:
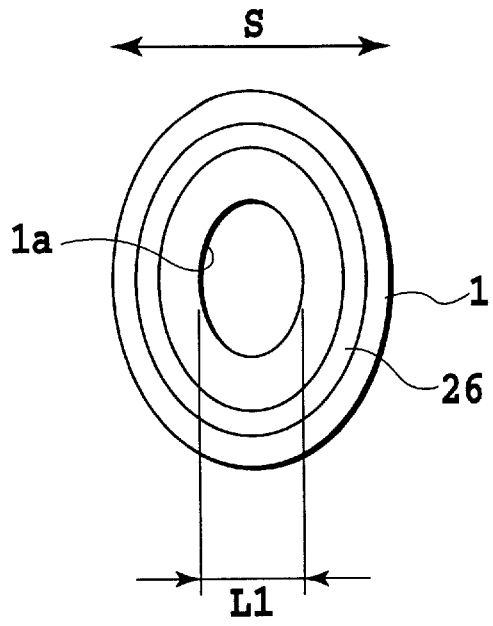
Figure 8B:
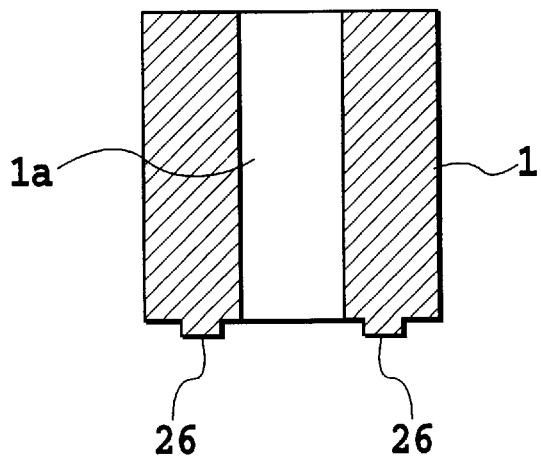
Figure 9B:
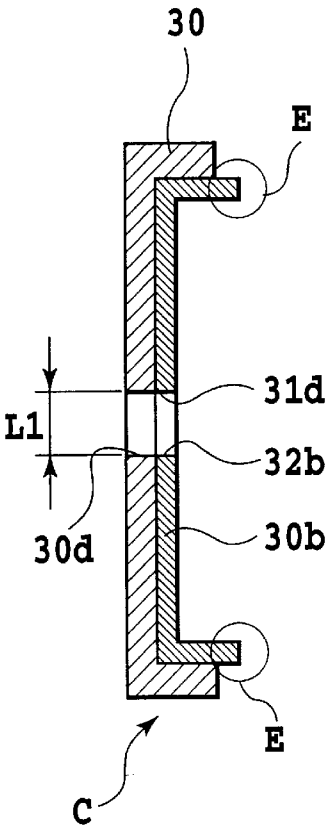
Figure 9A:
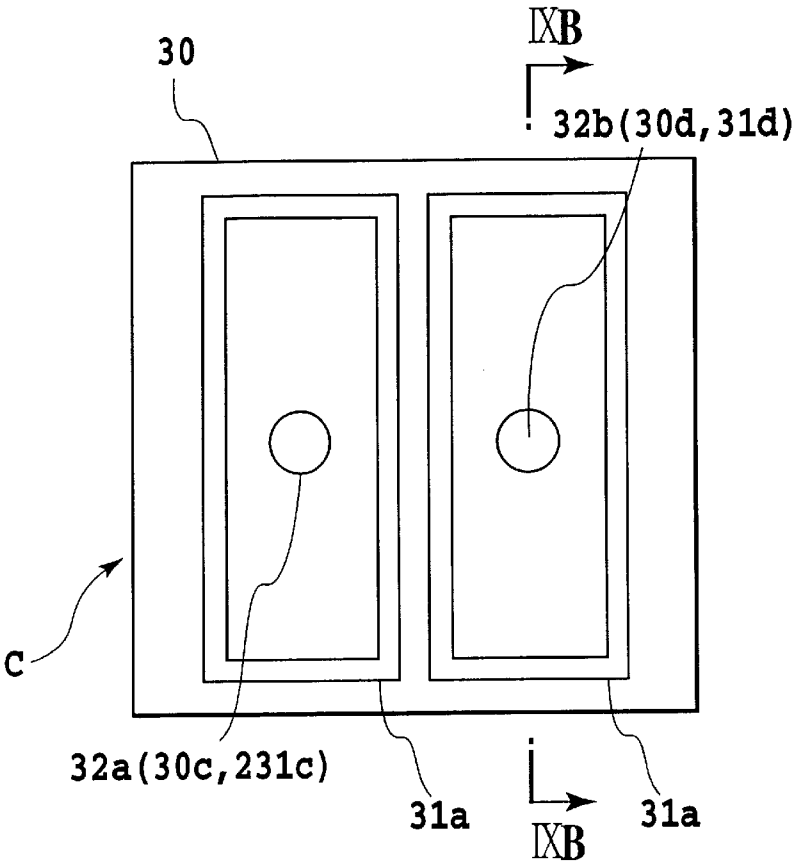

FIGS. 8A and 8B show the embodiment, in which the contact surface of the elastic member 1 mating with the ink ejection opening forming surface is elliptic, and the ink suction hole is also elliptic. On the other hand, in order to improve fitting ability with the ink ejection opening forming surface, an annular projection 26 is provided at the tip end of the elastic member 1. The elastic member 1 is moved with sealingly fitting the annular projection 26 onto the ink ejection opening forming surface with sucking the ink. In order to move with abutting onto the ink ejection opening forming surface and sucking the ink without damaging the ink ejection openings, it is preferred to move the elastic member 1 in a direction S for high deflection ability.

Figure 10:
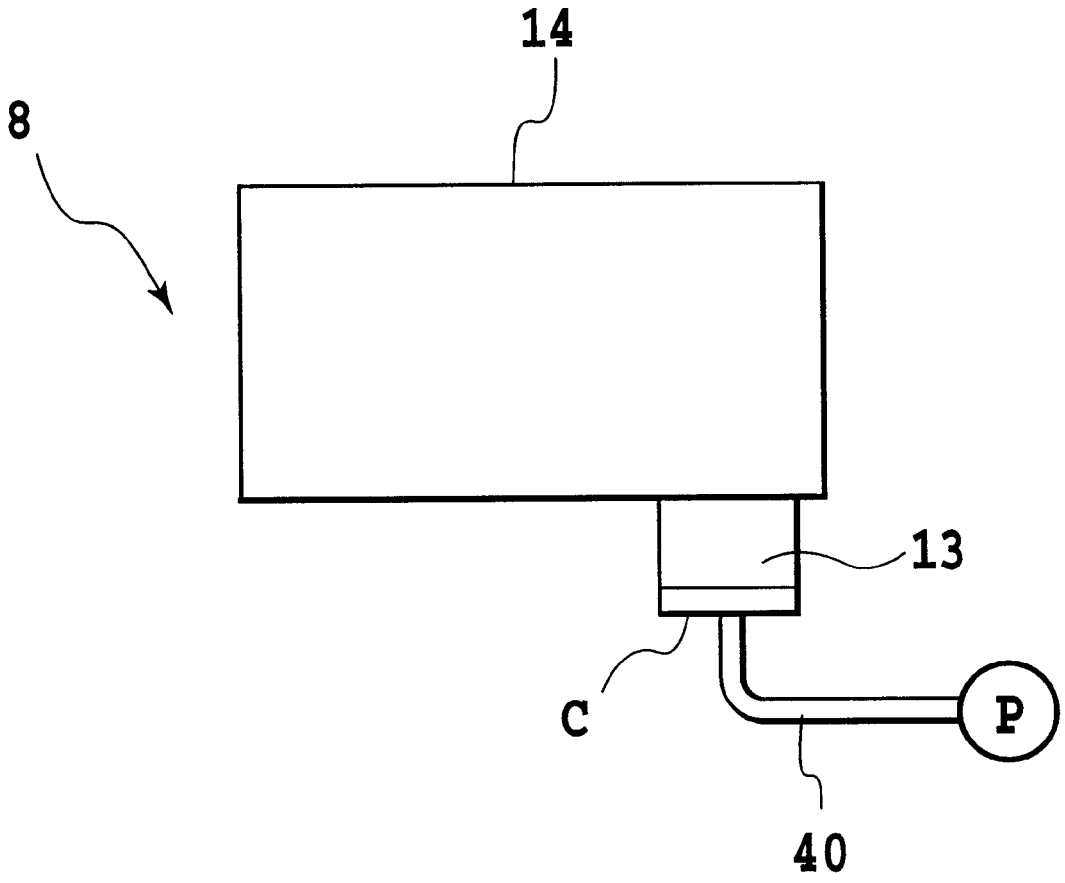
FIG. 10 is a front elevation showing a relationship between the conventional ink-jet printing head and the recovery cap.
Figure 11B:
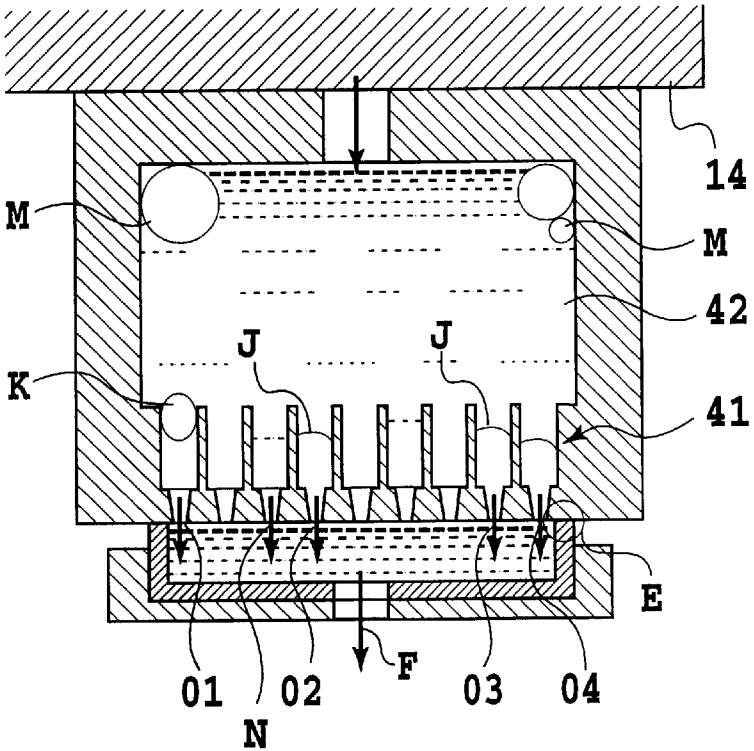
FIG. 11B is an enlarged section showing a condition where recovery operation is performed for filling-up ink into the ink chamber and the ink passage from abutting condition of FIG. 11B.
Figure 11A:
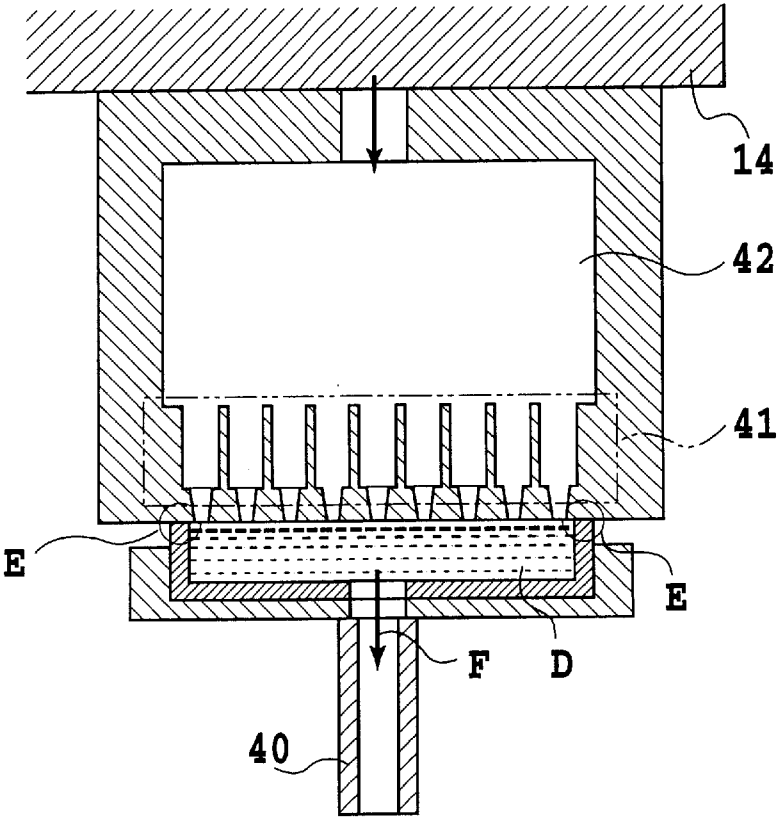
FIG. 11A is an enlarged section showing a condition where the ink cartridge and the recovery cap in FIG. 10 are in abutment.

It should be noted that, in order to reduce requirement for contact precision onto the ink ejection opening as shown in FIG. 10, the inner diameter L1 of the elliptic suction hole 1*a* is set on the shorter diameter side and the direction perpendicular to the motion direction S is set on the longer diameter side.

As set forth above, the elastic member to be used in the ejection recovery system is preferred to be a flexible material, such as a silicone type rubber, a butyl type rubber or the like in order to obtain a deflection ability to be satisfactorily fitted onto the ink ejection opening forming surface and to prevent the ink ejection opening forming surface from being damaged.

The present invention achieves distinct effects when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied to either on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably. In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ejection recovery system for a liquid ejection head including an array of ejection openings for ejecting liquid and a recessed surface provided with the array of said ejection openings and along the array of said ejection openings, liquid passages communicated with said ejection openings, and ejection energy generating elements provided in said liquid passages and generating energy sufficient for ejecting said liquid, comprising:

a cover member having a cover opening for covering at least one of said ejection openings and moving along said recessed surface during contacting with said surface provided with said ejection openings of said liquid ejection head arranged for orienting said surface including said ejection openings to an upward direction; and suction means for generating a vacuum pressure introduced into a space defined by said cover member and said surface including said ejection openings and for performing suction from said at least one of said ejection openings covered by said cover member through said cover opening as said surface including said ejection openings orients to the upward direction.

2. An ejection recovery system as set forth in claim 1, wherein, assuming a diameter of said cover opening of said cover member being L1 and a length of an array of said ejection openings aligned in a row being L2, a relationship of L1<L2 is established, and said system further comprises moving means for relatively moving said cover member and said surface including said ejection openings of said liquid ejection head in a direction of length of said array of said ejection openings.

3. An ejection recovery system as set forth in claim 2, wherein, assuming a diameter of said cover opening of said cover member is L1 and a length of said array of said ejection openings aligned in a row is L2, a relationship $$1<L2/L1<500$$

is satisfied.

4. An ejection recovery system as set forth in claim 1, which further comprises ultrasonic wave generating means for applying an ultrasonic wave to said liquid ejection head when vacuum pressure is introduced into said space defined by said cover member and said surface including said ejection openings of said liquid ejection head by said suction means.

5. An ejection recovery system as set forth in claim 1, wherein said liquid ejection head is placed in an environmental atmosphere at a temperature in a range of about 35° C. to 80° C., when vacuum pressure is introduced into said space defined by said cover member and said surface including said ejection openings of said liquid ejection head by said suction means.

6. An ejection recovery system as set forth in claim 1, which further comprises temperature adjusting energy generating elements, separate from said ejection energy generating elements, for temperature adjustment provided in said liquid passages of said liquid ejection head for adjusting said liquid at a predetermined temperature, and a temperature of said liquid ejection head is adjusted in a range of about 35° C. to 60° C. by driving said temperature adjusting energy generating elements, when vacuum pressure is introduced into said space defined by said cover member and said surface including said ejection openings of said liquid ejection head by said suction means.

7. An ejection recovery system as set forth in claim 6, wherein said temperature adjusting energy generating element is a thermal energy generating element for generating thermal energy sufficient for heating said liquid.

8. An ejection recovery system as set forth in claim 1, wherein said cover member has flexibility.

9. An ejection recovery system as set forth in claim 8, wherein a material of said cover member is selected among Si type rubber and Bu type rubber.

10. An ejection recovery system as set forth in claim 1, which further comprises monitoring means for optically monitoring a condition of said liquid passages and a liquid chamber communicated with said liquid passages in said liquid ejection head, and suction by said suction means is performed again when said liquid passages and said liquid chamber in said liquid ejection head as monitored by said monitoring means are not fully filled with the liquid.

11. An ejection recovery system as set forth in claim 1, wherein each of said ejection energy generating elements is a thermal energy generating element generating thermal energy sufficient for ejecting said liquid.

12. An ejection recovery system as set forth in claim 1, wherein, assuming that a sectional area of said cover opening of said cover member is S1 and summation of areas of said ejection openings covered by said cover opening is S2, a relationship $$10{,}000 \geqq S1/S2 \geqq 10$$

is satisfied.

13. An ejection recovery method for a liquid ejection head including an array of ejection openings for ejecting liquid and a recessed surface provided with the array of said ejection openings and along the array of said ejection openings, liquid passages communicated with said ejection openings, and ejection energy generating elements provided in said liquid passages and generating energy sufficient for ejecting said liquid, comprising the steps of:

arranging said surface including said ejection openings orienting to an upward direction;

contacting a cover member having a cover opening for covering at least one of said ejection openings and moving along said recessed surface during contacting with said surface provided with said ejection openings of said liquid ejection head from above; and performing suction from said at least one of said ejection openings covered by said cover member through said cover opening by a vacuum pressure introduced into a space defined by said cover member and said surface including said ejection openings as said surface including said ejection openings orients to the upward direction.

14. An ejection recovery method as set forth in claim 13, wherein, assuming a diameter of said cover opening of said cover member being L1 and a length of an array of said ejection openings aligned in a row being L2, a relationship of L1<L2 is established, and said method further comprises a step of relatively moving said cover member and said surface including said ejection openings of said liquid ejection head in a direction of length of said array of said ejection openings.

15. An ejection recovery method as set forth in claim 14, wherein, assuming a diameter of said cover opening of said cover member is L1 and a length of said array of said ejection openings aligned in a row is L2, a relationship $$1 < L2/L1 \leqq 500$$

is satisfied.

16. An ejection recovery method as set forth in claim 13, which further comprises a step of applying an ultrasonic wave to said liquid ejection head when vacuum pressure is introduced into said space defined by said cover member and said surface including said ejection openings of said liquid ejection head.

17. An ejection recovery method as set forth in claim 13, which further comprises a step of placing said liquid ejection head in an environmental atmosphere at a temperature in a range of about 35° C. to 80° C., when vacuum pressure is introduced into said space defined by said cover member and said surface including said ejection openings of said liquid ejection head.

18. An ejection recovery method as set forth in claim 13, which further comprises a step of driving temperature adjusting energy generating elements, separate from said ejection energy generating elements, for temperature adjustment provided in said liquid passages for adjusting a temperature of said liquid ejection head in a range of about 35° C. to 60° C., when vacuum pressure is introduced into said space defined by said cover member and said surface including said ejection openings of said liquid ejection head.

19. An ejection recovery method as set forth in claim 18, wherein said temperature adjusting energy generating element is a thermal energy generating element for generating thermal energy sufficient for heating said liquid.

20. An ejection recovery method as set forth in claim 13, wherein said cover member has flexibility.

21. An ejection recovery method as set forth in claim 20, wherein a material of said cover member is selected among Si type rubber and Bu type rubber.

22. An ejection recovery method as set forth in claim 13, which further comprises a step of optically monitoring a condition of said liquid passages and a liquid chamber communicated with said liquid passages in said liquid ejection head, and performing suction again when said liquid passages and said liquid chamber in said liquid ejection head as monitored are not fully filled with the liquid.

23. An ejection recovery method as set forth in claim 13, wherein each of said ejection energy generating elements is a thermal energy generating element generating thermal energy sufficient for ejecting said liquid.

24. An ejection recovery method as set forth in claim 13, wherein, assuming that a sectional area of said cover opening of said cover member is S1 and summation of areas of said ejection openings covered by said cover opening is S2, a relationship $$10{,}000 \geqq S1/S2 > 10$$

is satisfied.

25. A liquid ejection printing apparatus performing printing by ejecting liquid to a printing medium from a liquid ejection head including an array of ejection openings for ejecting liquid and a recessed surface provided with the array of said ejection openings and along the array of said ejection openings, liquid passages communicated with said ejection openings and ejection energy generating elements provided in said liquid passages and generating energy sufficient for ejecting said liquid, comprising:

a carriage for mounting said liquid ejection head;

an ejection recovery system including a cover member having a cover opening for covering at least one of said ejection openings and moving along said recessed surface during contacting with said surface provided with said ejection openings of said liquid ejection head arranged for orienting said surface including said ejection openings to an upward direction and suction means for generating a vacuum pressure introduced into a space defined by said cover member and said surface including said ejection openings and for performing suction from said at least one of said ejection openings covered by said cover member through said cover opening as said surface including said ejection openings orients to the upward direction; and changing means for changing a direction of said carriage for orienting said surface including said ejection openings of said liquid ejection head to the upward direction.

26. A liquid ejection printing apparatus as set forth in claim 25, wherein, assuming a diameter of said cover opening of said cover member being L1 and a length of an array of said ejection openings aligned in a row being L2, a relationship of L1<L2 is established, and said system further comprises moving means for relatively moving said cover member and said surface including said ejection openings of said liquid ejection head in a direction of length of said array of said ejection openings.

27. A liquid ejection printing apparatus as set forth in claim 26, wherein, assuming a diameter of said cover opening of said cover member is L1 and a length of said array of said ejection openings aligned in a row is L2, a relationship $$1 < L2/L1 \leqq 500$$

is satisfied.

28. A liquid ejection printing apparatus as set forth in claim 25, which further comprises ultrasonic wave generating means for applying an ultrasonic wave to said liquid ejection head when vacuum pressure is introduced into said space defined by said cover member and said surface including said ejection openings of said liquid ejection head by said suction means.

29. A liquid ejection printing apparatus as set forth in claim 25, wherein said liquid ejection head is placed in an environmental atmosphere at a temperature in a range of about 35° C. to 80° C., when vacuum pressure is introduced into said space defined by said cover member and said surface including said ejection openings of said liquid ejection head by said suction means.

30. A liquid ejection printing apparatus as set forth in claim 25, which further comprises a temperature adjusting energy generating element, separate from said ejection energy generating elements, for temperature adjustment provided in said liquid passage of said liquid ejection head for adjusting said liquid at a predetermined temperature, and a temperature of said liquid ejection head is adjusted in a range of about 35° C. to 60° C. by driving said temperature adjusting energy generating element, when vacuum pressure is introduced into said space defined by said cover member and said surface including said ejection openings of said liquid ejection head by said suction means.

31. A liquid ejection printing apparatus as set forth in claim 30, wherein said temperature adjusting energy generating element is a thermal energy generating element for generating thermal energy sufficient for heating said liquid.

32. A liquid ejection printing apparatus as set forth in claim 25, wherein said cover member has flexibility.

33. A liquid ejection printing apparatus as set forth in claim 32, wherein a material of said cover member is selected among Si type rubber and Bu type rubber.

34. A liquid ejection printing apparatus as set forth in claim 25, which further comprises monitoring means for optically monitoring a condition of said liquid passages and a liquid chamber communicated with said liquid passages in said liquid ejection head, and suction by said suction means is performed again when said liquid passage and said liquid chamber in said liquid ejection head as monitored by said monitoring means are not fully filled with the liquid.

35. A liquid ejection printing apparatus as set forth in claim 25, wherein each of said ejection energy generating elements is a thermal energy generating element generating thermal energy sufficient for ejecting said liquid.

36. A liquid ejection printing apparatus as set forth in claim 25, wherein, assuming that a sectional area of said cover opening of said cover member is S1 and summation of areas of said ejection openings covered by said cover opening is S2, a relationship $$10{,}000 \geqq S1/S2 \geqq 10$$

is satisfied.

* * * * *

UNITED STATES PATENT AND TRADEMARK OFFICE

CERTIFICATE OF CORRECTION

PATENT NO. : 6,543,876 B2
DATED : April 8, 2003
INVENTOR(S) : Kotaki

It is certified that error appears in the above-identified patent and that said Letters Patent is hereby corrected as shown below:

Title page,
Item [56], References Cited, FOREIGN PATENT DOCUMENTS, "JP 0 661 162" should read -- EP 0 661 162 --.
Item [57], ABSTRACT,
Line 1, "inkjet" should read -- ink-jet --.

Column 1,
Line 21, "know" should read -- known --; and
Line 25, "to an" should read -- to as an --.

Column 2,
Lines 39 and 41, "oriented the" should read -- oriented to the --.

Column 3,
Line 20, "and an" should read -- and --; and
Line 33, "low,." should read -- low. --.

Column 4,
Line 16, "above,a" should read -- above, a --.

Column 6,
Line 3, "preferably be" should read -- preferably --; and
Line 66, "comprises" should read -- comprise --.

Column 9,
Line 48, "opening-forming" should read -- opening forming --.

Column 10,
Line 34, "double of" should read -- double the --;
Line 55, "in, X" should read -- in X --;
Line 50, "stage, 4" should read -- stage 4 --; and
Line 59, "member 10" should read -- member 1 --.

Column 11,
Line 36, "member" should read -- member 1. --.

UNITED STATES PATENT AND TRADEMARK OFFICE

CERTIFICATE OF CORRECTION

PATENT NO. : 6,543,876 B2
DATED : April 8, 2003
INVENTOR(S) : Kotaki

It is certified that error appears in the above-identified patent and that said Letters Patent is hereby corrected as shown below:

Column 15,
Line 26, "1800," should read -- 180° --;
Line 34, "of" should read -- of the --; and
Line 59, "member 10" should read -- member 1 --.

Column 17,
Line 19, "consists" should read -- consist --.

Column 18,
Line 63, "$1<L2/L1<500$" should read -- $1<L2/L1\leq 500$ --.

Column 21,
Line 6, "$10,000\geq S1/S2>10$" should read -- $10,000\geq S1/S2\geq 10$ --.

Signed and Sealed this

Sixth Day of January, 2004

JAMES E. ROGAN
*Director of the United States Patent and Trademark Office*